United States Patent [19]

Hour

[11] Patent Number: 4,945,805

[45] Date of Patent: Aug. 7, 1990

[54] ELECTRONIC MUSIC AND SOUND MIXING DEVICE

[76] Inventor: Jin-rong Hour, No. 37, Lane 99, Nan-Wan St., Nan-Wan Village, Yung-Kang Shiang, Tainan, Taiwan

[21] Appl. No.: 277,976

[22] Filed: Nov. 30, 1988

[51] Int. Cl.[5] ..... G10H 1/08; G10H 1/36; G10H 7/00

[52] U.S. Cl. ..... 84/610; 84/625; 84/697; 84/712; 381/51

[58] Field of Search ..... 84/1.01, 1.03, 1.22, 84/1.23, 1.26, 1.28, DIG. 12, DIG. 22, 609–614, 625, 627, 697, 698, 702, 703, 712–717; 381/51; 446/81, 297, 397, 408; 369/63; 340/825.72

[56] References Cited

U.S. PATENT DOCUMENTS

| | | | |
|---|---|---|---|
| 4,596,032 | 6/1986 | Sakurai | 381/51 |
| 4,660,033 | 4/1987 | Brandt | 340/872.25 |
| 4,731,847 | 3/1988 | Lybrook et al. | 381/51 |
| 4,733,591 | 3/1988 | Kaneko et al. | 84/1.01 |
| 4,799,171 | 1/1989 | Cummings | 381/51 X |

*Primary Examiner*—Stanley J. Witkowski

*Attorney, Agent, or Firm*—Morton J. Rosenberg; David I. Klein

[57] ABSTRACT

An electronic music and sound mixing device, to be combined with a doll or a toy animal. The device comprising a mix ROM and a speech ROM for storing digital data of melodies, accompaniments and animal voices, a logical control circuit for controlling the operation of this device responsive to external signals to play a single song or all of the stored songs, once or continuously. The devices further include melody and accompaniment generators for treating the digital data read from the mix ROM and couples their output to a mix circuit which mixes the signals and shapes them into square waves for coupling to an amplifier for generating an audio output. The device can also output synchronized signals simultaneously to drive a motor to give facial expressions and limb movements to the toy animal in accordance with the song played.

5 Claims, 4 Drawing Sheets

ELECTRONIC MUSIC AND SOUND MIXING DEVICE

BACKGROUND OF THE INVENTION

So far conventional dolls or toy animals can only give out a monotonous cry so that they hardly possess enough recreational appeal and interest to satisfy the curiosity of young children.

This invention concerns an electronic music and sound mixing device for dolls or toy animals, which can not only play a variety of music but also provide a drive signal for use in changing the facial expression and the limb movement of a doll or a toy animal to correspond to the music played in order to maintain the interest of the player and provide recreation.

SUMMARY OF THE INVENTION

This device includes a mixing circuit, a D/A converter and animal sound circuit, a speech ROM & latch; a sample memory, a logical control circuit, a main melody generator, an accompaniment generator, a mix ROM, and an oscillator properly connected as shown in the drawings.

First, the logical control circuit receives an external signal to enable the mix ROM and the speech ROM for reading out the digital data of the melody, the accompaniment and the animal voice chosen which are respectively supplied to the main melody generator, the accompaniment generator and the D/A converter and animal sound circuit.

The main melody generator treats the digital data representing a melody with the reference frequency coming from an oscillator, and the resulting signals are then shaped by an enveloping circuit into square waves, which are fed to the mixing circuit.

The D/A converter and animal sound circuit comprises a digital-to-analog converter to convert the digital data representing the animal voice, and the facial expression and limb movements for mimicking the animal's singing into the analog data and supplies the analog animal voice signal to the mixing circuit.

The speech ROM & latch stores the digital data representing animal voice, and the facial expression and the limb movements supplied to the D/A converter and animal sound circuit.

The mixing circuit mixes the signals of the main melody, the accompaniment and the animal's voice and sends them out through terminal AUDO, with which an amplifier is connected to provide the audio output.

The sample memory treats the digital data with the reference frequency coming from an ocillator and feeds the sampled signal to a timing generator which enables the speech ROM and latch output the digital data of the animal voice.

The oscillator circuit produces an oscillating used as a reference frequency which is coupled to the main melody generator, the temp generator and the sample coupled.

DETAILED DESCRIPTION OF THE INVENTION

Figure 1:
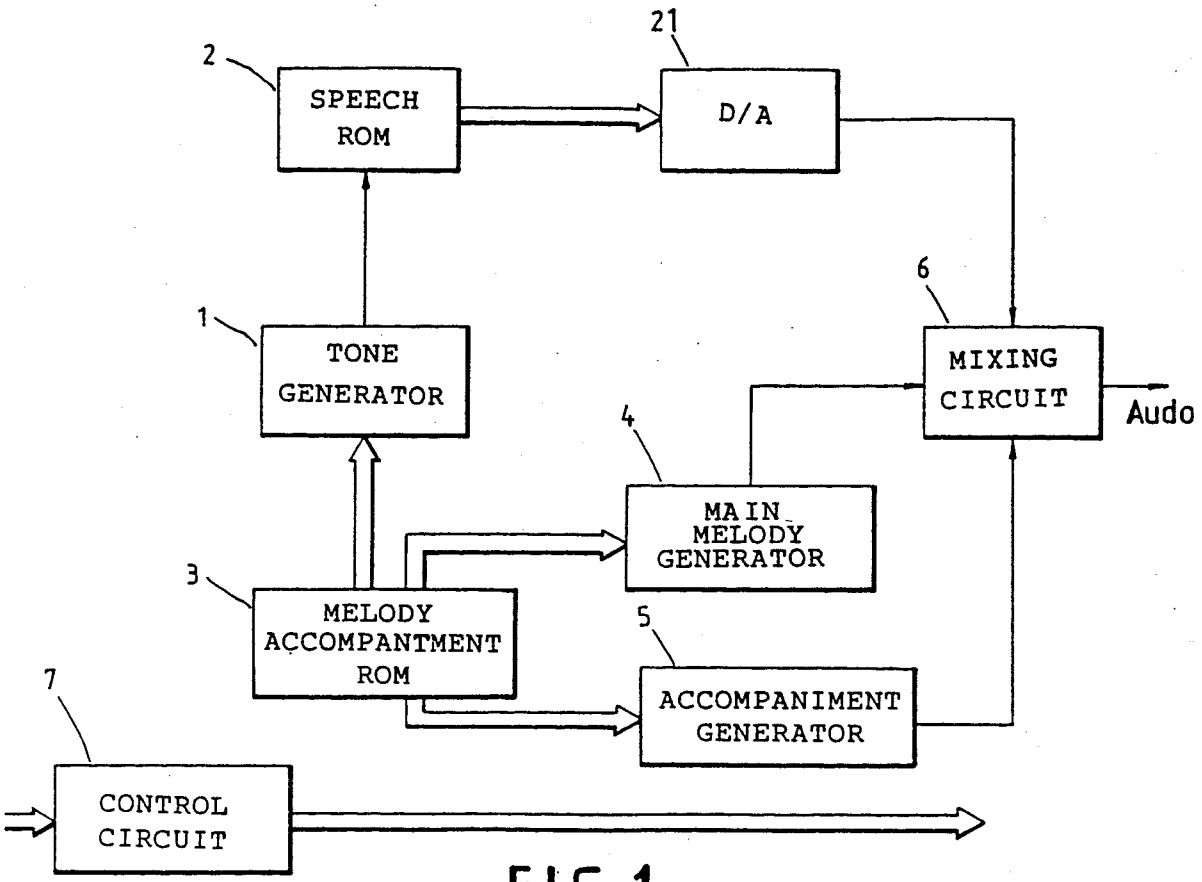
FIG. 1 is the flow chart of the electronic music and sound mixing device in accordance with the present invention.
Figure 2:
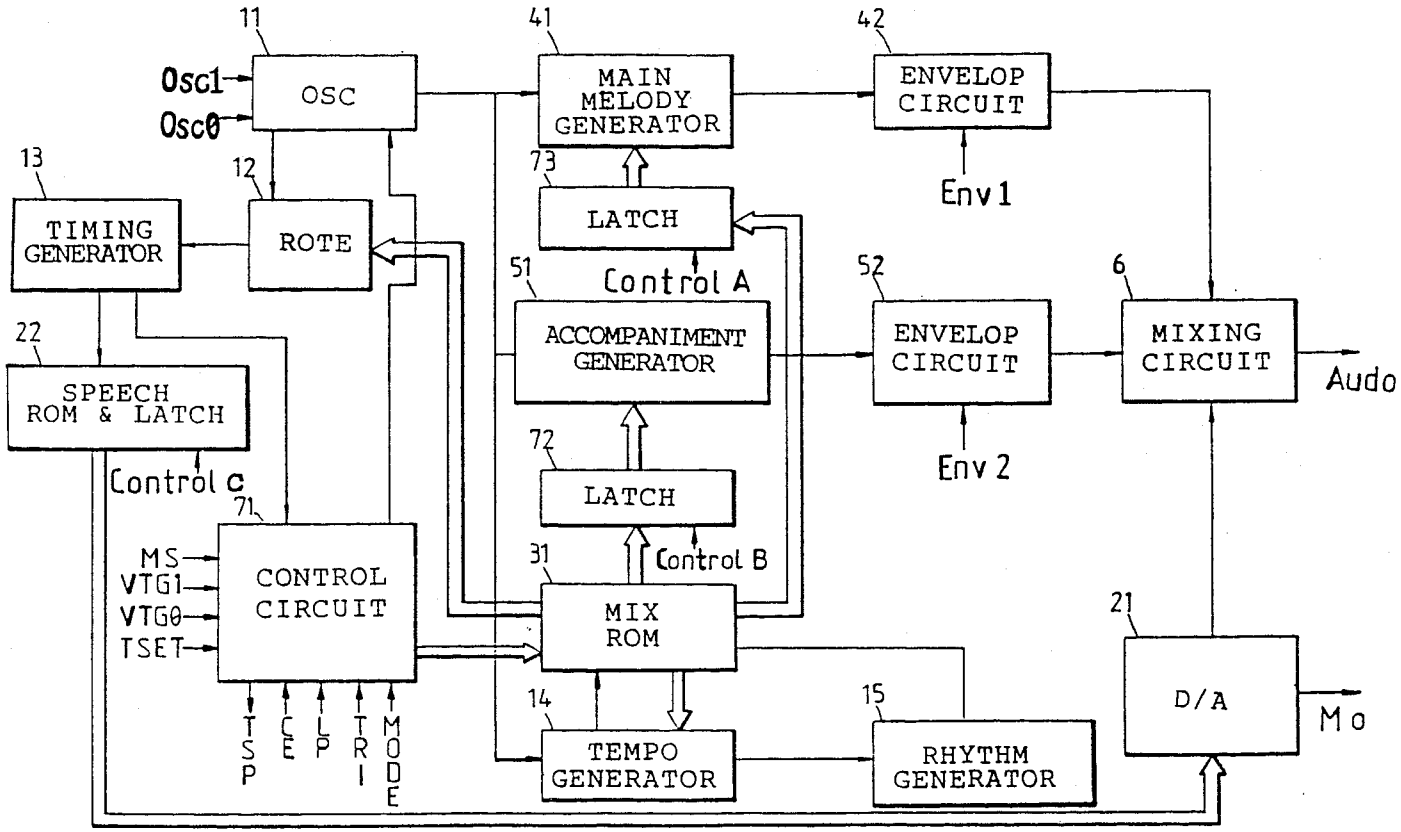
FIG. 2 is the block diagram of the system block diagram of the electronic music and sound mixing device in accordance with the present invention.

This device, as shown in FIGS. 1 and 2, comprises a melody and accompaniment ROM 31 which stores and supplies the digital representing data song and accompaniments which are then coupled to a main melody generator 41, an accompaniment generator 51, a tempo generator 14, and a rhythm generator 15 to produce signals of a melody and an accompaniment respectively, and these signals are fed in a mixing circuit 6, which mixes them to produce audio signals. This device also comprises a speech ROM to store and supply the digital data of animal's voice which are fed to a D/A converter and animal sound circuit 21 for converter the digital data into an analog signal and supplying it to the mixing circuit 6.

Figure 3:
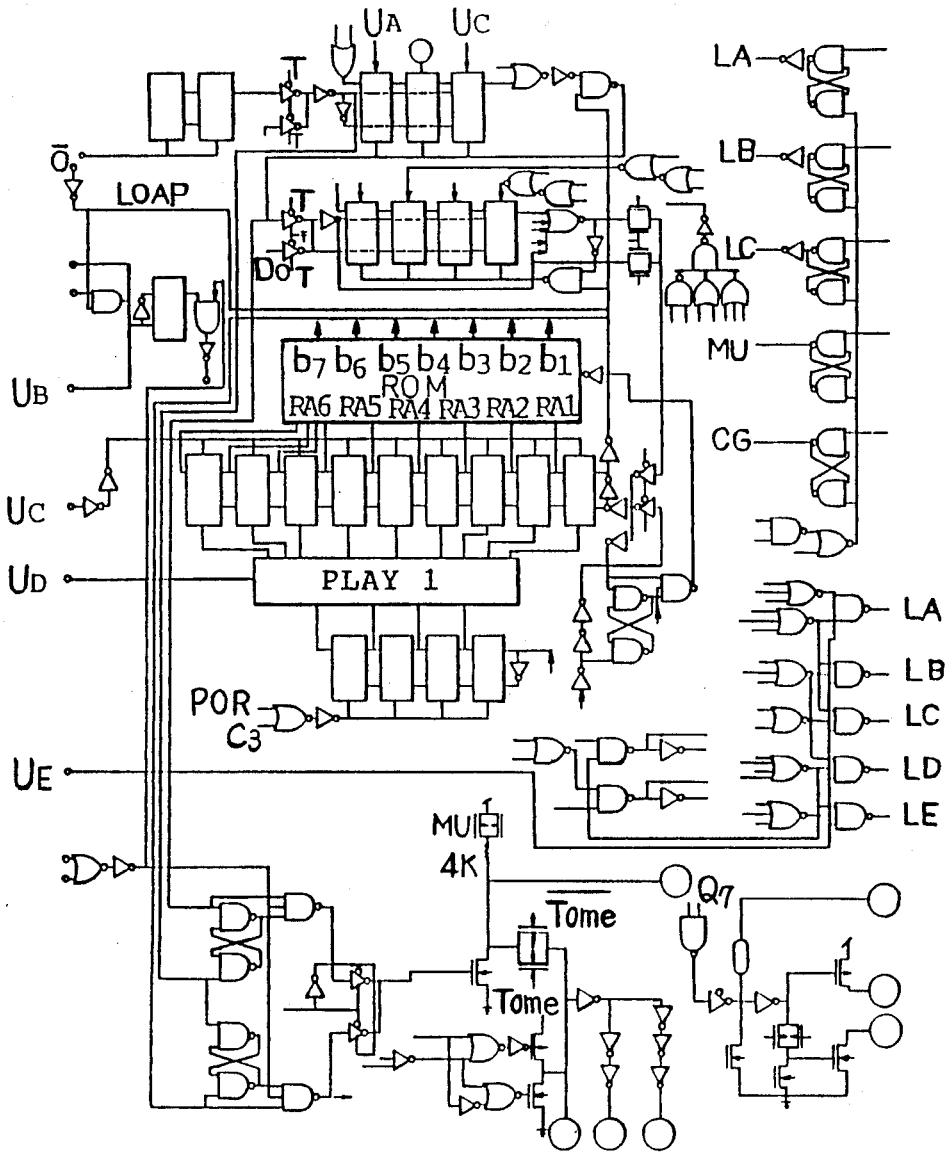
FIG. 3 is circuit the electronic circuit of the mix ROM in accordance with the present invention; and, FIG. 4 is the electronic circuit diagram of the accompaniment generator and the logical control circuit in accordance with the present invention.
Figure 4:
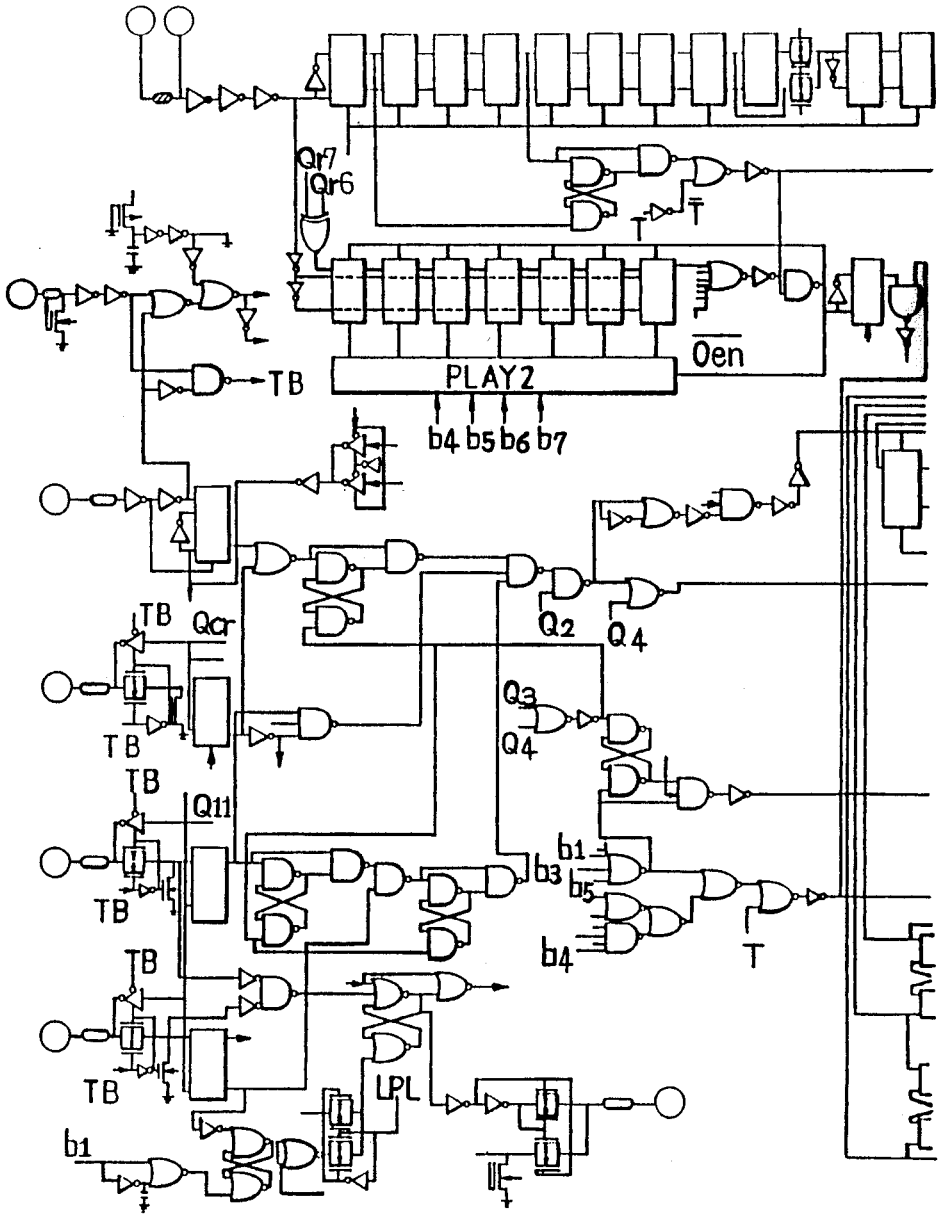

Next, the mixing circuit 6 as shown in FIGS. 2, 3 and 4, receives as an input the signals of the melody, the accompaniment and the animal voice, those signals are mixed to form a output signal coupled to the Terminal AUDO which is to be connected with an amplifier for producing the audio output of the music and the voice.

The D/A converter and animal sound circuit 21 includes a digital-to-analog converter for converting the digital data representing the animal voice into the analog signal which is treated and coupled to the mixing circuit 6 for mixing. The D/A converter and animal sound circuit 21 also has and output terminal Pin MO, through which the control signals for use in generating the facial expression and the limb movement of a toy animal are output.

A speech ROM and latch 22 is provided for storing digital data representing the animal voice, and the facial expression and the limb movements of the toy animal corresponding to the song, and has an external connection line disignated as Control C which determines whether or not the digital data is to be transmitted to the D/A converter and animal sound circuit 21 and then to the mixing circuit 6.

A sample memory 12 is provided to sample a signal after treating the melody with the reference frequency and to couple the signal to a timing generator 13, which, according to the sample signal, enables the speech ROM and latch 22 to read out the digital data representing the animal voice and facial expression and the limb movements of the animal toy in accordance with the melody.

The logical control circuit 71 receives external control signals, having Pin VTG 1 and VTG O connected with two different switches such as a sound-controlled switch, a light-controlled switch or a push-button switch. Pin TEST receives a test signal for checking normal operation of the device, Pin TSP is an output a flag for providing automatically stopping the melody, Pin CE controls the working of the circuit with a tri-state function. Pin LP provides means to choose to play only one song or all the songs, Pin MODE provides means to choose to continuously repeat playing the selected music or to automatically stop playing after the selected music has been completed and Pin TRI provides means to choose as a particular song. External connecting lines Control A, B, C and are respectively connected to a latch 73, a latch 72 and the speech ROM and latch 22 for selective inhibiting of transmission of the signals of the melody, the accompaniment and the animal voice, respectively, to be sent to the mixing aircuit 6, and Pin MO provides and output for the signals of the animal voice in accordance with the melody to control other components, such as a motor, so that the toy animal can change the facial expression and the limb movement according to the melody.

A main melody generator 41 treats the digital data of a melody coming from the latch 73 with the reference converting them into a signal of a particular frequency which is to be coupled to an enveloping circuit 42 for being shaped into square waves to produce better sound and then to be coupled to the mixing circuit 6. Pin ENV 1 of the enveloping circuit 42 can be connected with an external input.

The accompaniment generator 51 picks out the digital data of a proper accompaniment including rhythm and tempo from the mix ROM 3 and converts them into signals of a particular frequency with respect to the reference frequency, which is coupled to an enveloping circuit 52 to be shaped into square waves to produce better sound.

The mix ROM 31 stores the digital data of the melodies, the basic tone and the rhythm of the accompaniments. After receiving an actional signal, the mix ROM 31 reads out the digital data of the rhythm to the tempo generator 14 which, after treating the digital data with the reference frequency, transmits the resulting signal to the rhythm generator 15 for producing tempo signals; meanwhile, the digital data of the melody is also read out of the mix ROM 31 through the latch 73 to the main melody generator 41 and through the latch 72 to the accompaniment generator 51 and directly to the sample memory 12. The latches 72 and 73, are each connected with the respective connecting lines Control A and Control B for controlling transmission of the signals to the main melody generator and the accompaniment generator, respectively so that Terminal AUDO may or may not include the output of the melody and/or the accompaniment.

An oscillator circuit 11 is provided to produce a proper reference frequency according to the different melodies and rhythms and tempos, having Terminal OSC 1 and OSC 0 for external connection. The oscillation signals produced by the oscillator circuit 11 are fed as a reference frequency to the sample memory 12, the tempo generator and the main melody generator 14.

What is claimed is:

1. An electronic music and sound mixing device for dolls and toy animals, comprising:

(a) control circuit means for selectively controlling the operation of said device;

(b) read only memory means coupled to said control circuit means for providing previously stored digital data representing melodies and accompaniments as a digital data signal responsive to an actuation signal from said control circuit means;

(c) reference oscillator means coupled to said control citcuit means for generating a reference frequency oscillation signal;

(d) melody generator means coupled to said read only memory means and said reference oscillator means for generating a first signal derviced from the combination of said reference frequency oscillation signal and said digital data signal;

(e) accompaniment generator means coupled to said read only memory means and said reference oscillator means for generating a second signal derived from the combination of said reference frequency oscillation signal and said digital data signal;

(f) voice synthesis means coupled to said read only memory means and said reference oscillator means for generating a digital voice signal;

(g) digital-to-analog converter means coupled to said voice synthesis for (1) generating an analog voice signal, and (2) generating an analog drive signal responsive to said digital voice signal; and, (h) mixing circuit means coupled to (1) said melody generator means, (2) said accompaniment generator means, and (3) said digital-to-analog converter means for combining said first signal, said second signal and said analog voice signal to form a multivoice signal.

2. The electronic music and sound mixing device as recited in claim 1 where said melody generator means includes first envelope circuit means coupled to said mixing circuit means for providing said first signal with a square wave waveform.

3. The electronic music and sound mixing device as recited in claim 2 where said accompaniment generator means include second envelope circuit means coupled to said mixing circuit means for providing said second signal with a square wave waveform.

4. The electronic music and sound mixing device as recited in claim 1 where said melody generator means includes first latch circuit means coupled to said read only memory means for temporary storage of said digital data signal, said first latch circuit means including means for inhibiting the generation of said first signal.

5. The electronic music and sound mixing device as recited in claim 4 where said accompaniment generator means includes second latch circuit means coupled to said read only memory means for temporary storage of said digital data signal, said second latch circuit means including means for inhibiting the generation of said second signal.

* * * * *